US006152355A

United States Patent [19]

Morrow et al.

[11] Patent Number: 6,152,355

[45] Date of Patent: Nov. 28, 2000

[54] TUBULAR CONTAINER WITH RAISED PANEL DESIGN

[75] Inventors: Mark Morrow, Camden; James W. Lowry, Florence, both of S.C.

[73] Assignee: Sonoco Development, Inc., Hartsville, S.C.

[21] Appl. No.: 09/249,210

[22] Filed: Feb. 12, 1999

[51] Int. Cl.[7] ..... B65D 5/56

[52] U.S. Cl. ..... 229/4.5; 206/459.5; 493/94; 493/111; 493/152

[58] Field of Search ..... 229/4.5, 922; 206/459.5; 428/34.2; 493/84, 94, 111, 112, 152, 154, 155, 906, 907

[56] References Cited

U.S. PATENT DOCUMENTS

| | | | |
|---|---|---|---|
| D. 140,741 | 4/1945 | Serra . | |
| 247,213 | 9/1881 | Peck . | |
| 1,450,476 | 4/1923 | Wood . | |
| 2,001,919 | 5/1935 | Nolte . | |
| 2,489,503 | 11/1949 | Sampson et al. . | |
| 2,943,540 | 7/1960 | McBain . | |
| 3,035,753 | 5/1962 | Erekson . | |
| 3,154,237 | 10/1964 | Culley . | |
| 3,215,328 | 11/1965 | White . | |
| 3,288,341 | 11/1966 | Krause | 229/4.5 |
| 3,381,594 | 5/1968 | Ellebrock et al. | 229/4.5 |
| 3,495,736 | 2/1970 | Ragettli . | |
| 3,510,050 | 5/1970 | Culley et al. . | |
| 3,520,463 | 7/1970 | Ahlemeyer | 229/4.5 |
| 3,940,496 | 2/1976 | Turpin et al. . | |
| 4,264,657 | 4/1981 | Tollette | 428/34.2 |
| 4,286,745 | 9/1981 | Fukuoka | 229/4.5 |
| 4,538,439 | 9/1985 | Frei . | |
| 4,978,406 | 12/1990 | Nakano . | |
| 5,076,440 | 12/1991 | Drummond . | |
| 5,209,372 | 5/1993 | Norwood . | |
| 5,399,217 | 3/1995 | Bloom . | |
| 5,589,021 | 12/1996 | Bloom . | |
| 5,713,824 | 2/1998 | Drummond et al. . | |
| 5,766,709 | 6/1998 | Geddes et al. | 428/34.2 |
| 5,820,016 | 10/1998 | Stropkay | 206/459.5 |

FOREIGN PATENT DOCUMENTS

| | | |
|---|---|---|
| 1 205 595 | 9/1970 | United Kingdom . |

*Primary Examiner*—Gary E. Elkins
*Attorney, Agent, or Firm*—Alston & Bird LLP

[57] ABSTRACT

A composite multi-ply tubular consumer products container having an outwardly visible raised design formed along a sidewall thereof is disclosed. The container is comprised of a continuous body ply wrapped about a longitudinal axis into an elongate tubular shape. The body ply has an exterior surface on which at least one protruding or raised panel member is positioned, whereupon a continuous label ply is wrapped about the exterior surface of the body ply and the at least one protruding member so that the at least one protruding member forms the raised design on that portion of the label ply wrapped thereabout. A method of making such a container, and an apparatus on which the container may be made, are also disclosed.

28 Claims, 5 Drawing Sheets

TUBULAR CONTAINER WITH RAISED PANEL DESIGN

FIELD OF THE INVENTION

The present invention relates in general to consumer products containers. More particularly, the invention relates to a tubular composite multi-ply consumer products container having an outwardly visible protruding or raised panel design formed along the sidewall of the container, as well as to a method and apparatus of manufacturing such a container.

BACKGROUND OF THE INVENTION

A wide variety of food and drink products, as well as other perishable items, are packaged in tubular composite multi-ply containers constructed to be opened at either one of two spaced ends which are sealed, either permanently or with a removable seal, or by being opened along a sidewall seam, in order to gain access to the products packaged within the container. Composite multi-ply containers such as these are also commonly used to package cleaning products, for example powdered cleansers, as well as selected petroleum products to include lubricating greases.

Multi-ply containers of this type are typically formed on an elongate shaping mandrel by wrapping the several plies of the container about the mandrel in known fashion. Accordingly, these containers will have a continuous liner ply, typically an impervious layer such that the products packaged within the container will not leak out of the container nor allow ambient air to enter into the container; a continuous structural body ply, typically made of paperboard which is wrapped about the liner ply and adhered thereto during the container formation process; and a continuous exterior label ply wrapped about the body ply and bearing any desired product trade dress and/or markings thereon. These multi-ply containers can also be formed by using a series of guides, or plows, to convolutely wrap the plies of the container about the shaping mandrel, such that rather than having a spiral or helical seam, the container will have a longitudinal seam where the various plies adjoin themselves as they are wrapped about the mandrel.

Composite multi-ply containers of this type have been well received in the marketplace, and thus are now found in use throughout a wide variety of applications, as described above. Due to the common usage of these types of containers, however, the need has arisen to provide an improved composite multi-ply container which will distinguish the container, and the products packaged therein, when placed in a retail display environment so that the package and the product therein becomes more noticeable. Although the markings printed as a part of the label ply serve, to some extent, to attract a consumer's attention to the container, when faced with a variety of otherwise identically sized and shaped containers, consumers will not necessarily notice any one container more so than any other container.

Additionally, the products packaged within the container, for example refrigerated doughs, can oftentimes exert an internal pressure or force directed radially outwardly of the container such that the need exists to improve the container's resistance to rupture by reinforcing the sidewall of the container. Also, along with reinforcing the sidewall of the container, any such reinforcement should also act to provide a cushioning effect so that as the containers are handled during processing, shipment, and display, they will be cushioned along their sidewalls in the effort to minimize sidewall rupture and/or damage. In particular, it would be desirable that these containers have an improved resistance to being crushed through side impact, and which will tend to evenly distribute the force of such impacts along the length of the container sidewall.

One such example of a composite multi-ply container which presents the need for improved sidewall strength and sidewall cushioning, in conjunction with a need for improved thermal insulation, is a refrigerated dough container of the type known in which the composite multi-ply tubular container is provided with a pair of metal or plastic end caps affixed to the tube. A label ply is constructed and arranged to be at least partially delaminated from about the body ply in order to allow access to the continuous joint formed in the body ply as it is wrapped about the shaping mandrel, and which joint is pressed with a blunt object, for example the rounded tip of a knife, to "pop" the container open by using the pressure of the dough to force the container open. By providing a container with improved sidewall strength and which will also have greater thermal insulation properties along its sidewall, the dough will be less likely to become warmed and will then not seek to expand as quickly as it would otherwise.

Lastly, and as known to most consumers, these types of composite multi-ply containers are formed to have a smooth continuous sidewall, such that when the body ply is overwrapped with the label ply, these containers will typically have a slick or glossy appearance and feel such that the possibility exists that the container can slip from a consumer's hand during use damaging both the container and the products packaged therein. Thus, it is desirable to provide an improved multi-ply container which will be easier to grasp and hold along its sidewall.

Examples of multi-ply containers used for packaging products are disclosed in U.S. Pat. Nos. 2,943,540 to McBain; U.S. Pat. No. 3,035,753 to Erekson; U.S. Pat. No. 3,154,237 to Culley; and U.S. Pat. No. 3,940,496 to Turpin, et al. The containers disclosed in the patents to Erekson, Culley, and Turpin are spirally wound multi-ply refrigerated dough containers of the type generally described above, each of which is constructed to be opened by exposing the spiral seam of the body ply portion of the container by either removing the label ply and exposing the body ply, or by grasping a tab and removing an elongate strip which covers the seam for exposing the seam to open the container. In the patent to Turpin, et al., this strip is shown to be a spirally wound reinforcing element received on the body ply of the container on the butt joint formed where the side edges of the body ply adjoin one another as it is wrapped about the shaping mandrel. This reinforcing strip is designed to be affixed to and removed with the label, or to be permanently adhered to the body ply such that after the label is removed and the reinforcing strip is grasped and pulled, the body ply will be opened by the strip.

Accordingly, it would be desirable to provide an improved composite multi-ply container having improved outward visibility for better consumer recognition. Such a container would also preferably improve the strength and cushion the sidewall of the container, and improve the insulation properties of the container. It would be even further beneficial if the container could be securely grasped by consumers in opening or handling the container. Such a container should be easy to manufacture on existing container manufacturing lines, rugged and durable both in structure and in use, but also be constructed to not otherwise hinder or impede the opening of the container at its ends, or along its sidewall.

SUMMARY OF THE INVENTION

It is to these, and the other objects and advantages of the present invention, which include not only an improved composite multi-ply container, but also a method and apparatus of manufacturing such a container, to which the invention is directed. The container of this invention has a body ply wrapped in known fashion about a longitudinal axis and formed into an elongate tubular shape, the spaced and opposed side edges of the body ply forming a continuous joint line which extends the length of the body ply when the side edges adjoin one another as the body ply is wrapped into its tubular shape. In heretofore unknown fashion, at least one protruding, also known as a raised panel, member is positioned on an outwardly facing exterior surface of the body ply, such that when a continuous label ply is wrapped about the exterior surface of both the body ply and the protruding/raised panel member, the at least one raised panel member forms an outwardly visible protruding or raised panel design along the sidewall of the container on that portion of the label ply wrapped thereabout.

In one aspect of this invention, namely for a multi-ply container which is constructed to be opened at one, or both, of its ends, the at least one raised panel member is placed on the exterior surface of the body ply, where and as desired, whereupon the continuous label ply is wrapped about the exterior surface of the body ply so that the at least one raised panel member forms an outwardly visible raised panel design along the sidewall of the container. For a second aspect of the invention, namely for a multi-ply container which is constructed to be opened along the joint line of the body ply forming the sidewall of the container, the at least one raised panel member is placed on the exterior surface of the body ply at a position spaced from the joint line so as not to interfere with the opening of the container.

The at least one raised panel member which is placed along the outwardly facing exterior surface of the body ply may comprise a single elongate strip member, or a plurality, as desired, of spaced and parallel elongate strip members, extending along all, or a portion, of the container sidewall. In another aspect, the at least one raised panel member may comprise a discrete graphic design member which is placed in a desired location on the exterior surface of the body ply prior to wrapping the label ply thereover. It is anticipated that a number of these discrete graphic design members could be provided in spaced series along a carrier film, for example a polymeric film or a paperboard strip adapted to be wrapped about the container as it is shaped about a shaping mandrel. The elongate strip may be a continuous die-cut strip which is formed to have a repeating or continuous graphic design.

An advantageous method of forming a raised panel display on a composite multiply tubular consumer products container results from the unique construction of this container. The container is formed by first wrapping a continuous liner ply about the longitudinal axis of a shaping mandrel. A continuous body ply, having a pair of spaced side edges, is then wrapped about the liner ply and is adhered thereto. A continuous joint line is formed and extends the length of the body ply where the side edges of the body ply adjoin one another as the body ply is wrapped about the liner ply. The next step of this method is to place at least one protruding, or raised panel, member on an outwardly facing exterior surface of the body ply, and to then wrap a label ply about the body ply and the at least one raised panel member. This results in the formation of an outwardly visible protruding, or raised panel, design along the elongate sidewall of the container on that portion of the label ply wrapped thereabout.

The at least one raised panel member may be placed on the exterior surface of the body ply at a position spaced from the joint line, or may be placed in any desired position along the sidewall for containers constructed to be opened at one of their two respective ends rather than along the sidewall. The method of placing the at least one raised panel member on the exterior surface of the body panel can include the step of wrapping at least one elongate continuous strip member about the body ply, or, if desired, the placement of a discrete graphic design member on the exterior surface of the body ply. Moreover, the wrapping of a carrier ply, for example a polymeric film, on which a spaced series of discrete graphic design members are provided, is also envisioned by this method of forming a multi-ply container.

An apparatus for manufacturing a composite multi-ply consumer products container having an outwardly visible raised panel design thereon also forms a part of the invention. The apparatus includes a supply of a continuous liner ply and a supply of a continuous body ply, as well as an elongate shaping mandrel. An endless drive belt is provided, the drive belt being constructed and arranged to wrap the liner ply about the mandrel, to then overwrap the body ply about the liner ply, and to advance both of the liner ply and the overwrapped body ply together in the lengthwise direction of the mandrel. First an adhesives application station is positioned upstream of the drive belt for applying a suitable adhesive to an interior surface of the body ply prior to its being wrapped about the liner ply. The apparatus also includes a supply of a protruding, or raised panel, member for being wrapped about the body ply, and a placement/positioning device positioned with respect to the mandrel and downstream of the drive belt, which device is constructed and arranged to place the at least one raised panel member on the exterior surface of the body ply at a desired position, whereupon a continuous label ply is provided which is wrapped about the body ply and the at least one raised panel member situated on the exterior surface of the body ply.

BRIEF DESCRIPTION OF THE DRAWINGS

Some of the objects and advantages of the present invention have been stated above, and others will appear as the description proceeds when taken in conjunction with the accompanying drawings, which are not necessarily shown to scale, in which.

DETAILED DESCRIPTION OF THE INVENTION

Figure 1:
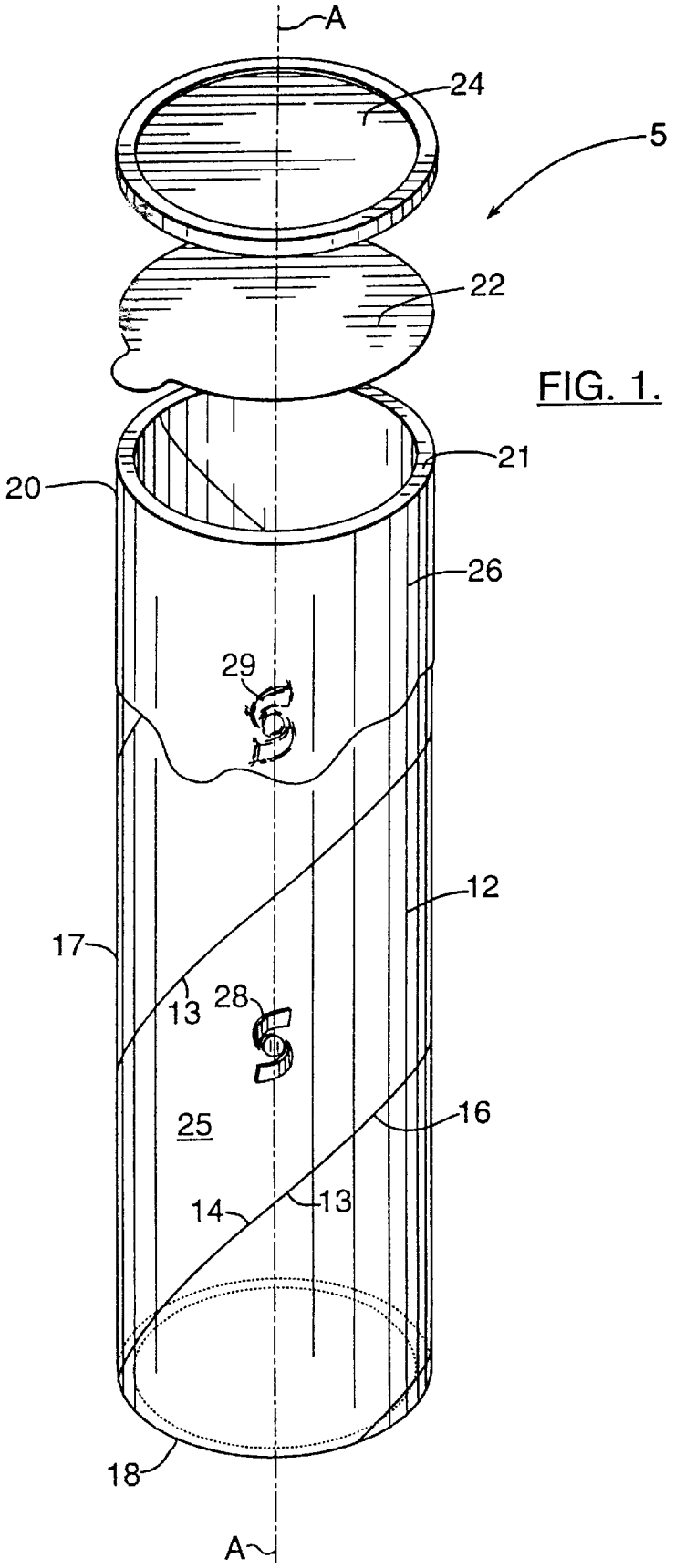
FIG. 1 is a partially cut-away perspective view of a first embodiment of a composite multi-ply container having a discrete graphic design member provided as a raised panel member on the exterior surface of the container body ply.

The present invention will now be described more fully hereinafter with reference to the accompanying drawings, in which like reference numerals indicate like parts throughout the several views, and in which preferred embodiments of the invention are shown. It is understood by those skilled in the art, however, that this invention may be embodied in many different forms and should not be construed as being limited to the embodiments as set forth herein; rather, these embodiments are provided so that the disclosure will be thorough and complete, and will fully convey the scope of the invention to those skilled in the art.

A first embodiment of a tubular composite multi-ply container 5 according to the present invention is illustrated in FIG. 1. Although container 5 is illustrated as being circular in cross-section, it is understood by those skilled in the art that the container may have another cross-sectional shape which can be formed as an elongate tubular body about an appropriately shaped mandrel. One example of such a geometric shape is a generally rectangularly shaped tube having rounded comers.

Figure 2:
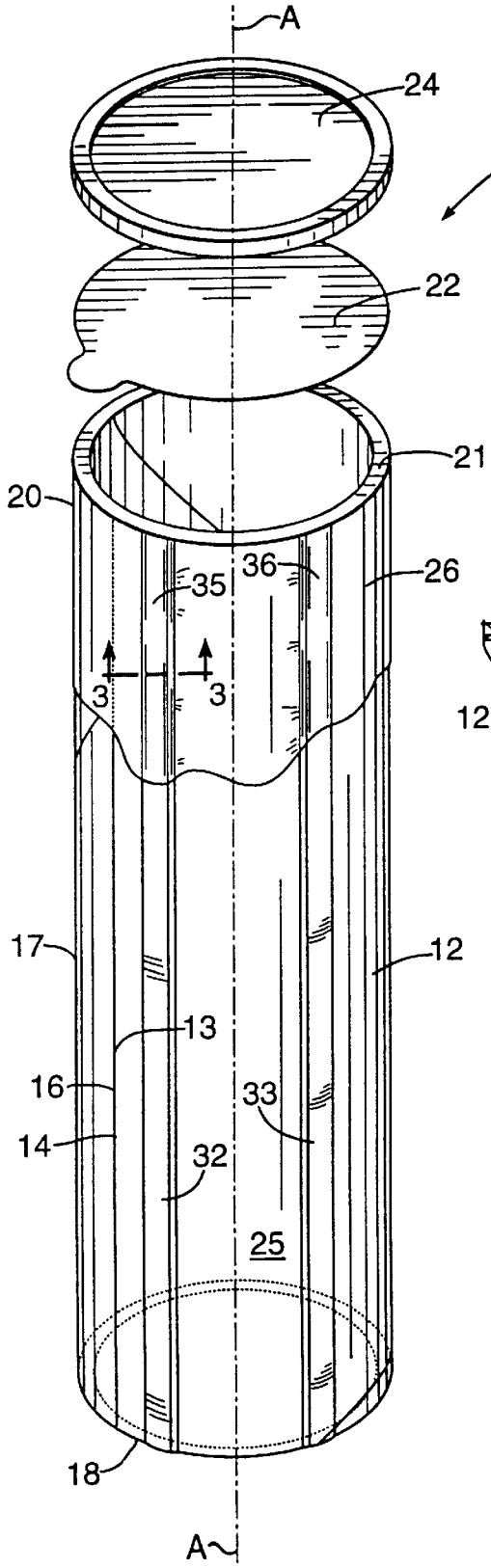
FIG. 2 is a partially cut-away perspective view of a second embodiment of a composite multi-ply container, formed as a convolute container, having a pair of spaced and parallel continuous elongate strip members provided as raised panel members on the exterior surface of the container body ply.
Figure 4:
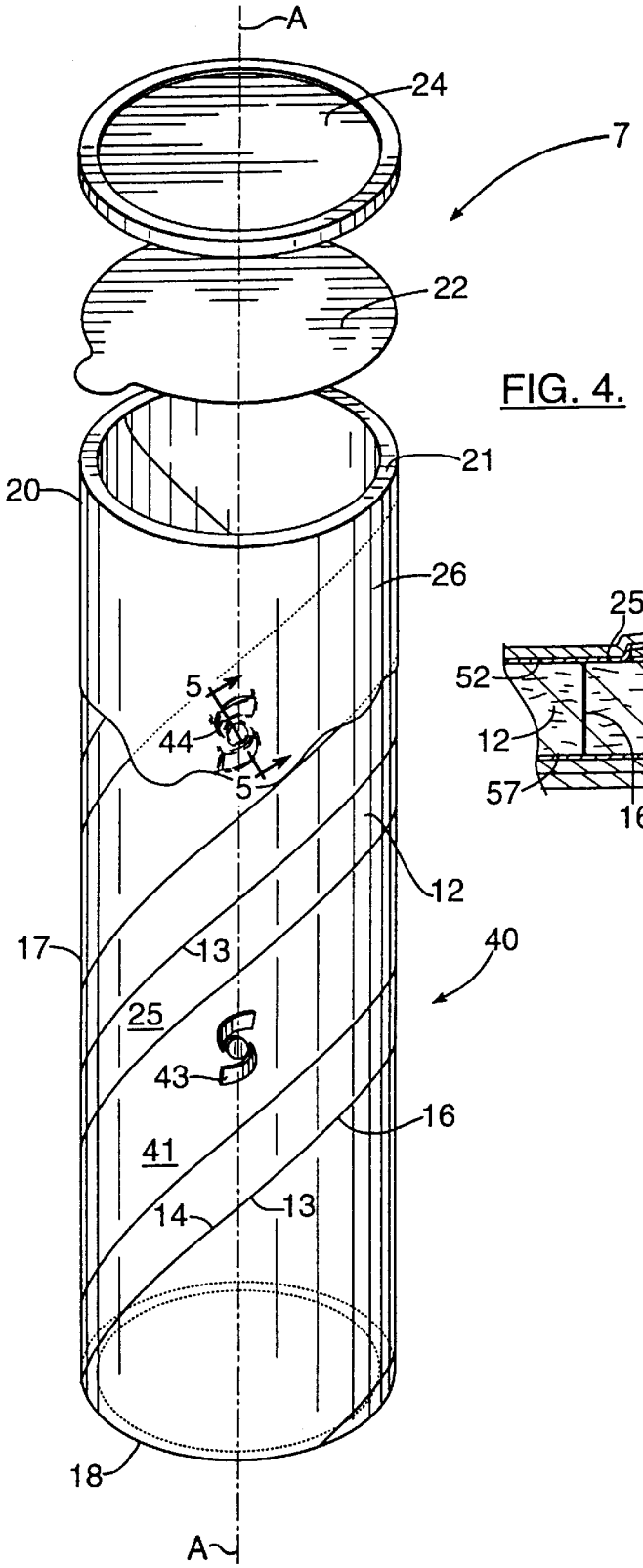
FIG. 4 is a partially cut-away perspective view of a third embodiment of a composite multi-ply container having a continuous elongate strip member wrapped about the exterior surface of the container body ply as a raised panel member, the strip member having a spaced series of graphic design members provided as a part thereof.
Figure 6:
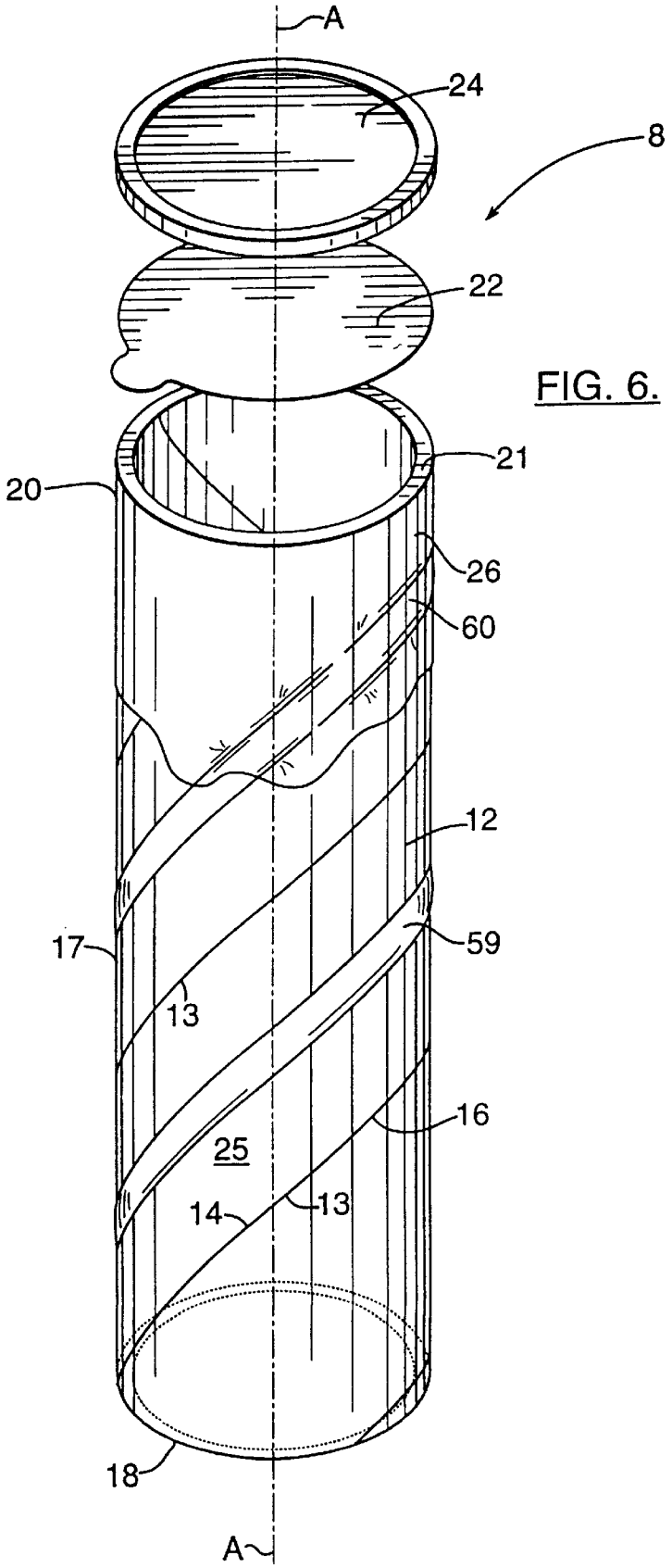
FIG. 6 is a partial perspective view of a fourth embodiment of a composite multiply container having a single elongate continuous strip member wrapped about the container body ply as a raised panel member.

The embodiment of container 5 illustrated in FIG. 1, as well as the containers 6–8 illustrated in FIGS. 2, 4, and 6, respectively, are particularly well suited for packaging food products, for example potato crisps, as well for packaging other consumer products such as cleaning or petroleum products. Among those products which may be packaged within containers 5–8 will be frozen juice concentrates, refrigerated doughs and pastries, powdered beverages, snacks, shortening, nuts, pet food, institutional foods, and miscellaneous foods, to include cereal and coffee, as well as paints and coatings, powdered cleansers, and/or petroleum products, including lubricating greases, for example.

Container 5 is formed as an elongate tube out of an elongate continuous body ply 12 having a first side edge 13 and a second spaced side edge 14, which, when the body ply is wrapped about a longitudinal axis A into an elongate tubular shape, for example container 5 of FIG. 1, the opposed side edges of the body ply will adjoin one another along the length of the body ply and will form a continuous joint line 16 also extending the length of the body ply. In this fashion, the body ply 12 forms an elongate continuous sidewall 17 of the container, at which a first or bottom end 18 is defined, and a second or spaced top end 20 is also defined. First end 18 is not shown in greater detail, but it is understood by those skilled in the art that first end 18 typically will include a metallic or plastic cap which is permanently sealed on the end of the container after it is filled with the product to be packaged as a part of the packaging operation. The second end of the container, which is intended to be opened in this instance, will have an annular bead or flange 21 formed thereat which extends continuously about the periphery of the second end, upon which a seal 22, for example a foil, paper or film seal, is placed in sealing relationship for ensuring that the products stored within container 5 are kept in an airtight container. In known fashion, an end cap 24 constructed and arranged to be snapped over the annular bead or flange 21 is provided, such that the foil seal 22 is protected from accidental removal until the container is opened by the end consumer. As is known to those of ordinary skill in the art, the container may not be hermetically sealed in the case of certain expansible products, such as refrigerated dough, for example.

Figure 7:
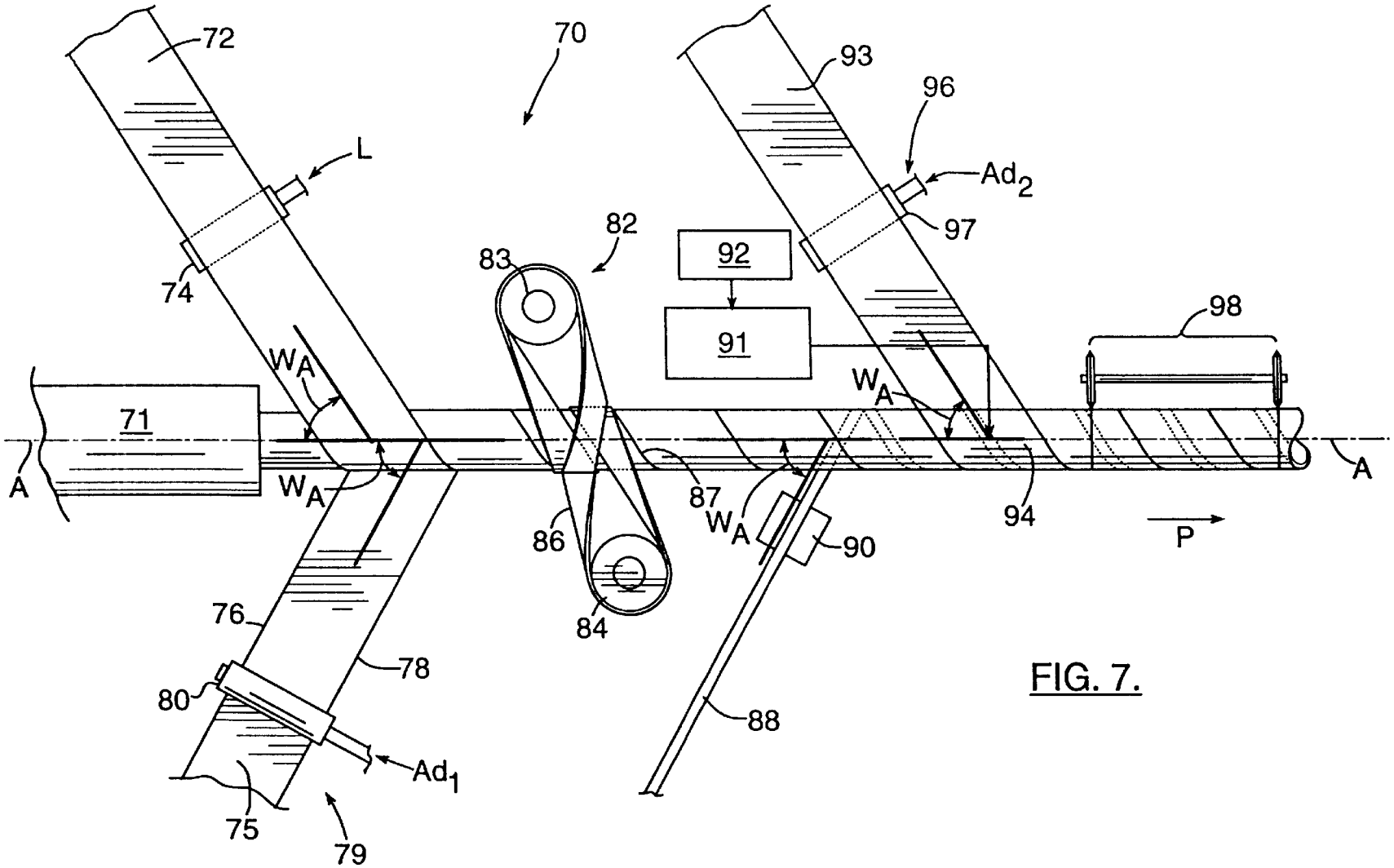
FIG. 7 is a plan view of an apparatus according to the present invention for making a composite multi-ply tubular consumer products container having an outwardly visible raised panel design provided as a part thereof.

Still referring to FIG. 1, an exterior surface 25 is formed by that portion of body ply 12 facing outwardly of axis A, and about which a continuous label ply 26 is wrapped, as shown for example by the apparatus 70 in FIG. 7, for forming a composite multi-ply container, and in this particular instance a composite multi-ply container which is constructed to be opened at one of its ends. Although containers 5–8 are shown as opening at one of the respective ends thereof, it is anticipated that any one of these containers can be constructed such that the body ply 12 can be opened along the continuous joint line 16 in known fashion, for example, when used with refrigerated doughs and pastries.

In the first embodiment of container 5 shown in FIG. 1, a protruding, or raised panel, member 28, in this instance a discrete, e.g., a die-cut, graphic design member is placed on the exterior surface 25 of body ply 12 prior to label ply 26 being wrapped about both of the body ply and the raised panel member. As shown along the upper portion of container 5 in FIG. 1, once the label ply is wrapped about the raised panel member, an outwardly visible protruding, or raised panel, design 29 is formed on the portion of the label ply wrapped thereabout, such that the container now has a distinctive appearance which will help to distinguish the container, and thus the articles packaged therein, in the eyes of the consumer.

It is anticipated that body ply 12 of each of the respective containers illustrated in FIGS. 1–7 will preferably be formed of a paperboard which is capable of being wrapped about axis A, and more particularly about the periphery of the elongate shaping mandrel 71 as shown in FIG. 7, such that the tubular container can be formed into the desired geometric shape and cross-section, here circular. It is anticipated that raised panel member 28, in all of its embodiments, disclosed herein may be fashioned from the same paperboard material as is body ply 12, or may be fashioned from other materials, as desired. For example, other such advantageous materials used for forming raised panel member 28 may include a resilient foam, for example a thin microfoam, a bubble wrap of the known type in which air pockets are formed between a sandwiched layer of film, as well as of a suitable flexible plastic material, to include, for example, polyester, polystyrene, polyethylene, and/or polypropylene, for providing side impact resistance, and for also providing a raised grip surface such that the elongate sidewall 17 of the container can be grasped easily.

Although a protruding or raised "panel" member is referred to herein with regard to the unique construction of the several embodiments of the container of this invention, it is understood by those skilled in the art that this refers to any type of body member, no matter how shaped or sized, which is intended to be placed on the exterior of the container body ply for the purpose of forming an outwardly visible protruding or "raised panel" design along the side wall of the container. Thus a panel, commonly thought to include an elongate planar body, as such, is not required to be used as the protruding or raised "panel" of this invention, nor is an outwardly visible raised "panel" design, compared to a protruding design, the necessary result of the several embodiments of the invention discussed herein, or in future embodiments made possible by the teaching of this invention.

As label ply 26 is wrapped about the body ply it is adhered thereto with a suitable adhesive, preferably an aqueous, also known as a "wet", adhesive of the type(s) suitable for use with food products and approved by the United States Food and Drug Agency, or similar agencies having regulatory authority over the construction of food packaging containers. Also, as the label ply is wrapped about the body ply, one or any desired number of raised panel members 28 will be placed in position on the exterior surface of the body ply either manually, i.e., by hand, or by a suitable one of the known product placement or positioning devices 91 (FIG. 7) constructed to place separate ones of the raised panel member on the exterior surface of the body ply during the formation of the container 5, in a fashion described in greater detail hereinbelow.

Also, therefore, and if desired, as the raised panel member 28 is positioned on the exterior surface 25 of body ply 12, it can also be separately adhered to the body ply before the label ply 26 is adhered to the exterior surface of the body ply, or it may be captured and held in position on the exterior surface of the body ply by the label ply being wrapped thereabout. Regardless of how the raised panel member is placed and/or adhered to the body ply, it is anticipated that the raised panel member will be securely positioned along the sidewall of the container by the overwrapped label ply.

In the embodiment of container 5 shown in FIG. 1., as well as the embodiments of containers 6, 7, and 8, shown in FIGS. 2, 4, and 6, respectively, each of the respective raised panel members, for example raised panel member 28 in FIG. 1, is shown positioned on the exterior surface of body ply 12 at a position spaced from continuous joint line 16. If the respective containers are intended to be opened only at their ends, then the positioning of the raised panel members on the exterior surface of the body ply can be strictly a matter of choice, such that the raised panel member need not be spaced from the continuous joint line. If, however, the respective containers are used for the packaging and storage of refrigerated doughs or pastries, for example, which, in known fashion, are constructed to be opened along the continuous joint line 16 after label ply 26 is partially delaminated or where an access tab is otherwise removed in order to gain access to the continuous joint line, then and in that event the respective raised panel members will preferably be positioned on the exterior surface of the body ply at a position spaced from the continuous joint line such that they do not hinder or otherwise interfere with the opening of the container.

U.S. Pat. No. 3,940,496 to Turpin, et al. discloses a spirally wound can having a discrete label and reinforcing elements which extend along the continuous joint line on the exterior surface of the container and beneath the label ply. However, it is further disclosed in Turpin, et al. that this elongate reinforcing strip is positioned along the continuous joint line and is glued either to the label ply, or to the body ply in order to assist in the opening of the container along the continuous joint line.

A second embodiment of the container of this invention is illustrated in FIG. 2, in which an elongate tubular container 6 is illustrated. Container 6 of FIG. 2 is constructed in fashion similar to container 5 of FIG. 1, except that here the container is formed as a convolute container in which the separate plies used to form the container are wrapped by guides or plows (not illustrated) about a shaping mandrel such that continuous joint line 16 is formed into an elongate continuous longitudinal seam, rather than being a spirally wound seam as shown, for example, in FIGS. 1, 4, and 6. Container 6, however, is constructed of the same components illustrated for container 5 in FIG. 1, and thus the various aspects of the container itself are not described in greater detail.

Container 6 does differ from container 5 in that it is provided here with a pair of continuous elongate strip members as protruding or raised panel members 32, 33, respectively, each of which is placed on the exterior surface 25 of the body ply 12 of container 6. Moreover, although two raised panel members are shown here, it is anticipated that a spaced series of elongate strip members of any desired number may be positioned on exterior surface 25 of the container.

Accordingly, after the body ply 12 has been wrapped about a shaping mandrel such that first side edge 13 and second side edge 14 adjoin one another to form the continuous joint line 16 extending along the longitudinal length of the container, the first raised panel member 32 and the second raised panel member 33 are placed in position on the exterior surface 25 of the body ply, whereupon label ply 26 is wrapped thereabout to complete the formation of the container sidewall 17. Once this has been accomplished, and as best shown in FIGS. 2 and 3, a spaced pair of raised outwardly visible protruding or raised panel designs 35 and 36 are formed on the exterior of container 6.

As with container 5, and as with containers 7 and 8 of FIGS. 4 and 6, respectively, discussed in greater detail below, the respective raised panel members 32, 33 can be separately adhered to the exterior surface of the body ply, or can be held in position, i.e., captured, against the exterior surface of body ply 12 by label ply 26 as it is wrapped thereabout, all as desired. Body ply 12 of container 6 will again preferably be constructed of paperboard, and it is anticipated that raised panel members 32 and 33 can be made of the same paperboard material as is body ply 12, or from any of the other materials described above from which raised panel member 28 may be constructed.

Figure 3:
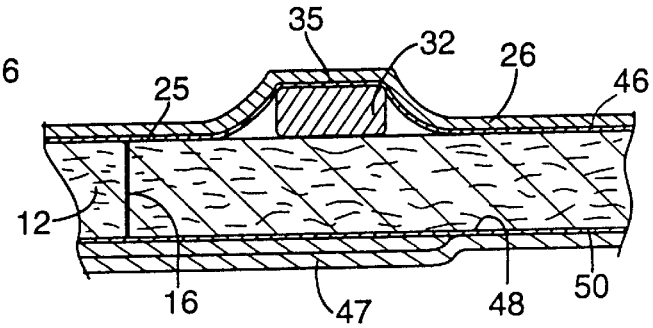
FIG. 3 is a partial sectional view along line 3—3 of FIG. 2.

FIG. 3 is an illustration along line 3—3 of FIG. 2 illustrating the manner in which one preferred embodiment of the improved composite multi-ply container of this invention is constructed, and how the raised panel design is formed on the exterior surface of the container. Body ply 12 is shown, the body ply having a butt joint or seam 16, with the exterior surface 25 of the body ply being overwrapped by the label ply 26, which label ply also overwraps the raised panel member 32 (FIG. 3), as well as any additional raised panel members, here raised panel member 33 (FIG. 2), positioned on the exterior surface of the body ply. This, in turn, forms the outwardly visible raised panel design 35 and 36, respectively, of FIG. 2.

Label ply 26 is adhered to the exterior surface of body ply 25 by a suitable adhesive 46 applied to the label ply prior to or simultaneous with the wrapping of the label ply about the body ply. Depending on the configuration of the adhesive application roller provided as a part of the container forming apparatus, the adhesive 46 may also extend along the interior surface of label ply 26 such that label ply 26 is adhered to raised panel member 32, although the raised panel member may be captured, as such, on the exterior surface of the body ply by the tension, only, of the overwrapped label ply.

In known fashion, a continuous liner ply 47 will be adhered to an interior surface 48 of the body ply by a suitable aqueous adhesive 50 for the purposes of providing a generally impervious liner on the inwardly facing surface of the container such that the products, for example food products or other consumer products, stored within the container will not be spoiled by outside air being allowed to migrate through the paperboard and into the container, and to also prevent the products stored within the container from softening, damaging, or destroying the paperboard of which body ply 12 is made to ensure the structural rigidity and shelf-life of the container and products stored therein, respectively.

A third embodiment of the improved container of this invention is illustrated in FIG. 4, which discloses an elongate tubular container 7 formed as a spirally wound tube from a body panel 12 wrapped about a longitudinal axis A. Container 7 is constructed in a fashion identical to container 5 of FIG. 1, with the exception that the protruding or raised panel member 40 in this instance comprises a continuous carrier strip 41 placed on the exterior surface 25 of the body ply 12, and wrapped spirally thereabout. The carrier strip is shown spaced from the continuous joint line 16 extending the length of sidewall 17 along the body ply. It is anticipated that for containers, such as containers 5–8, that are constructed to be opened at either of their two ends, that carrier strip 41 and the discrete graphic design member(s) 43 adhered thereto, or formed as a part thereof in the instance where strip 41 and design member(s) 43 comprise a continuous die-cut step, may be positioned where desired on the exterior surface 25 of body ply 12, to include being placed over the joint line 16.

Figure 5:
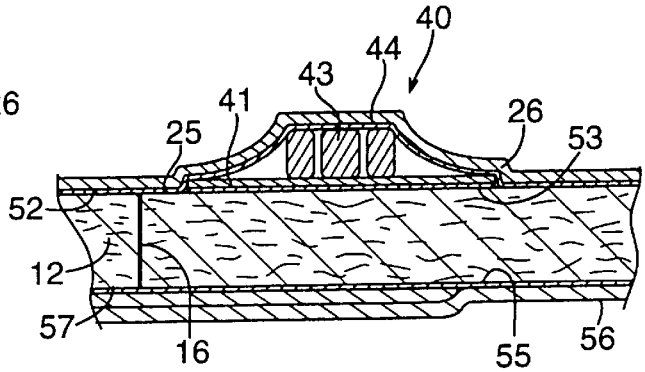
FIG. 5 is a partial sectional view along line 5—5 of FIG. 4.

The carrier strip 41 of FIG. 4 is shown having a spaced series of discrete graphic design members 43 adhered thereto, such that as label ply 26 is wrapped thereabout, as illustrated in FIGS. 4 and 5, an outwardly visible protruding or raised panel design 44 is formed on the label ply in the desired shape, design, or configuration on that portion of the label ply wrapped about the raised panel member. Although raised panel member 40 of FIG. 4 is shown as comprising a carrier strip and a spaced series of discrete graphic design members adhered thereto, all of which is wrapped about the exterior surface of body ply 12, it is anticipated that the raised panel member could comprise one, or a plurality, of spaced and parallel elongate strips similar to strips 32 and 33 of container 6 in FIG. 2, or may comprise a continuous elongate raised strip member as shown for container 8 of FIG. 6, with each such strip member being a continuous die-cut strip with the scrap portion of the strip being cut out to leave the desired graphic design behind.

An advantageous feature of providing raised panel member 40 in the construction shown in FIG. 4 is that the discrete graphic design members 43 can be die cut or otherwise mass produced quickly and easily, and then positioned on and adhered to the carrier strip at the desired spacing such that they will form the desired outwardly visible raised panel design, or pattern, on the exterior of the container once label ply 26 is wrapped thereabout, again for the purposes of product differentiation, as well as for the benefits of improved side impact resistance, insulation of the products within the container, and the ergonomic factor, namely the ability to grasp the container without fear that it will slide through the user's hand.

A partial side illustration, in cross-section, of the manner in which container 7 of FIG. 4 is constructed, is illustrated in FIG. 5. Body ply 12 is shown having a continuous joint line 16 within the sidewall 17, with the label ply 26 being wrapped over the exterior surface 25 thereof Here raised panel member 40, in particular carrier strip 41, is shown as being adhered to the exterior surface of body ply so that the raised panel member 43 forms an outwardly visible raised panel design 44 on the exterior surface of the container as label ply 26 is wrapped thereabout.

A suitable aqueous adhesive 52 is used to adhere label ply 26 to the exterior surface 25 of the body ply, and a suitable aqueous adhesive 53, which may be the same type of adhesive as is adhesive 52, is used to adhere carrier strip 41 to the exterior surface 25 of the body ply. An adhesive is applied continuously along the interior surface of label ply 26 such that it is adhered to the raised panel member 40. Also, although not illustrated, the discrete graphic design member 43 will be adhered to carrier strip 41 by a suitable adhesive.

Still referring to FIG. 5, the interior surface 55 of body ply 12 will be wrapped about a continuous liner ply 56, in known fashion, the liner ply being adhered to the interior surface of the body ply by a suitable adhesive 57.

A fourth embodiment of the tubular container of this invention is shown in FIG. 6, in which container 8 is shown once again as a spirally wound container constructed in the same fashion as is container 5 of FIG. 1, and container 7 of FIG. 4, respectively. The exception here, however, is that container 8 has a continuous elongate strip member 59 provided as the protruding or raised panel member on the exterior surface 25 of label ply 12, the strip member being spirally, or helically, wound about the longitudinal axis A, for example the axis of mandrel 71 of FIG. 8, as the container is formed. Once label ply 26 is wrapped about the raised panel member 59 and against the exterior surface 25 of the body ply 12, an outwardly visible protruding or raised panel design 60 is formed.

An advantageous feature, therefore, of the construction of containers 5–8, respectively, is that the inclusion of a raised panel member, of any desired size, shape, or configuration, along the exterior surface of sidewall 17 of the respective containers will distinguish the containers and the products carried therein for marketing purposes; will provide an improved resistance to sidewall rupture, dependent on the type of raised panel members used, for example a wide strip as opposed to a single discrete graphic member may provide better sidewall strength and cushioning along the container sidewall; may provide improved sidewall insulation for the product stored within the container, for example the use of a foam strip as the panel member for a container used to package refrigerated doughs or pastries; and ergonomically will provide a raised grip surface such that end users, for example consumers, can easily grasp the container and hold it in one hand while removing end cap 24 and seal 22 with the other hand to gain access to the products stored within the container.

FIG. 7 illustrates an apparatus 70 for forming the wound embodiments of the container 5, 7, and 8 of the invention described above. Apparatus 70 includes an elongate forming or shaping mandrel 71 of a desired geometric cross-section (not illustrated) which extends along a longitudinal axis A, and which is constructed in known fashion. Shaping mandrel 71 may also be provided with a cooling circuit (not illustrated) as a part thereof, for ensuring that the mandrel does not become overheated during the container forming process.

Apparatus 70 is provided with a continuous liner supply 72 which is passed over a lubrication application roller 74, provided with a suitable lubricant "L", along its interior surface prior to being wrapped about mandrel 71. The apparatus is also provided with a continuous body ply supply 75, the body ply having a first side edge 76 and a spaced second side edge 78 along the opposite sides thereof, which side edges adjoin one another as the container is wrapped about the mandrel to form a continuous joint line 87.

A first adhesives application station 79 is positioned with respect to the body ply supply, and has an adhesive application roller 80 provided with a suitable adhesive "$A_{d1}$", for example an aqueous adhesive, which will adhere the interior surface of the body ply to the exterior surface of the liner ply to form the "core" of the tubular container. The adhesives application station is positioned upstream of a drive assembly 82, having a pair of wheels, typically a drive wheel 83 and a driven wheel 84, with a continuous drive belt 86 passed thereabout and which is looped in known fashion about the body ply after it is overwrapped on the liner ply for the purposes of tightly wrapping the body ply about the liner ply, and which forms the joint line 87 and advances the container in the direction of the path of travel, denoted by the reference character "P", during the container formation process.

Positioned downstream of the drive assembly is a continuous raised panel member supply 88, in this instance a continuous elongate raised panel member strip, passed through a suitable and conventional guide 90 for being wrapped about the exterior surface of the body ply. In lieu thereof, or in addition to raised panel member supply 88, which may also comprise multiple strip like members (not illustrated) if so desired, is a separate placement or positioning device 91, constructed in known fashion, and which is provided with a supply of discrete graphic design members 92, as illustrated schematically, which it is constructed to pick and place on the exterior surface of the body ply as the container is being formed.

The discrete graphic design members can be die-cut in line, or pre-cut and then rewound The discrete graphic design members could also be applied manually to the exterior of the label ply. No matter what type of raised panel member is provided, however, whether a continuous strip like member such as raised panel member supply 88, or a discrete raised panel member, a supply of which is schematically illustrated at 92 in FIG. 7, either type of panel member will be positioned in the desired location on the exterior surface of the body ply 75 prior to the wrapping of the liner ply about the body ply 75.

As shown in FIG. 7, the liner ply 72 and the body ply 75 are both wound about axis A at a common wind angle "$W_A$" during the formation of the container's core tube. As the raised panel member ply 88 is wrapped about the body ply, in those instances where the raised panel member comprises an elongate strip, it too is wound about the body ply at the common wind angle "$W_A$" for ease of manufacture, and so that the strip member will be uniformly spaced from the joint line 87, when and where it is desirable to do so, for example where the container is constructed to be opened along joint line 87.

A second adhesives application station 96 is positioned downstream of the drive assembly and with respect to the label ply supply. The label ply is passed over an adhesives application roller 97, supplied with a suitable adhesive "$A_{d2}$" prior to being wrapped about the body ply and the raised panel member(s). As the label ply is wrapped about the body ply and the raised panel member, therefore, an outwardly visible raised panel design 94 is formed on the exterior surface of the container.

Positioned downstream of the label ply supply and the second adhesives application station is a conventional cutting station 98 used to cut the tubular container to the desired length, after which the tube is removed from the mandrel and the top annular bead, for example annular bead 21 of FIGS. 1, 2, 4, and 6 is formed, whereupon the appropriate end seal 22 is placed over the open end of the container, and a suitable end cap 24 is also provided. In known fashion, the bottom or "permanent" end cap will be sealed on the container after the products to be packaged are placed therein, during the packaging operation.

Many modifications and other embodiments of the invention will come to mind to one skilled in the art to which this invention pertains, having the benefit of the teachings presented in the foregoing descriptions and the associated drawings. Therefore, it is to be understood that the invention is not to be limited to the specific embodiments disclosed herein, and that modifications and other embodiments of the invention are intended to be included within the scope of the appended claims. For example, although several embodiments of the tubular containers according to the present invention have been described primarily in connection with food products, it is to be understood that the containers could be used in connection with other consumer products suitable for being packaged within a composite multi-ply container, and with which an outwardly visibly raised panel design is desirable. Moreover, although specific terms are employed herein, they are used in a generic and descriptive sense only, and not for the purposes of limiting the described invention, or the claims which follow hereinbelow.

What is claimed is:

1. A multi-ply tubular consumer products container, said container comprising:

a continuous body ply, said body ply having a pair of spaced and opposed side edges;

said body ply being wrapped about a longitudinal axis into an elongate tubular shape, said body ply having an exterior surface and a continuous joint line extending the length of the body ply where the side edges thereof adjoin one another as the body ply is wrapped into said tubular shape;

at least one protruding member positioned on the exterior surface of the body ply spaced from said joint line; and a continuous label ply wrapped about the exterior surface of the body ply and said at least one protruding member, said label ply being adhered to the exterior surface of the body ply, so that said at least one protruding member forms at least one outwardly visible raised design on the portion of the label ply wrapped thereabout.

2. The container of claim 1, wherein said body ply further comprises an interior surface, said container further comprising a continuous liner ply adhered to the interior surface of the body ply.

3. The container of claim 1, wherein said at least one protruding member is adhered to the exterior surface of the body ply.

4. The container of claim 1, wherein said label ply is adhered to said at least one protruding member.

5. The container of claim 1, wherein said at least protruding member is captured between the exterior surface of the body ply and the label ply wrapped thereabout without adhesive.

6. The container of claim 1, wherein said at least one raised protruding member extends at least partially along the length of the container.

7. The container of claim 1, wherein the body ply is spirally wound about the longitudinal axis of the container at a predetermined wind angle, and wherein said at least one protruding member is spirally wound about the exterior surface of the body ply at said wind angle.

8. The container of claim 1, said at least one protruding member comprising a first continuous elongate strip member wrapped about the exterior surface of the body ply.

9. The container of claim 8, said at least one protruding member further comprising a second continuous elongate strip member wrapped about the exterior surface of the body ply, said second strip member being spaced from and parallel to said first strip member.

10. The container of claim 8, said first strip member comprising a series of spaced and raised graphic design members extending at least partially along the length thereof.

11. The container of claim 1, wherein said container is sized and shaped as a convolute container, and wherein the joint line of said body ply is formed as a continuous longitudinal seam extending the length of the body ply.

12. The container of claim 1, said at least one protruding member comprising at least one discrete graphic design member placed on the exterior surface of said body ply.

13. The container of claim 1, said at least one protruding member comprising a continuous elongate strip member having a series of spaced and raised graphic design members provided as a part thereof.

14. A multi-ply tubular consumer products container, said container comprising:

a continuous body ply wrapped about a longitudinal axis and formed into an elongate tube, said tube having a pair of spaced ends;

a removable air-tight seal received on one of said ends, and a removable end cap sized and shaped to be passed about said seal and onto said one of said ends in sealing relationship therewith;

said body ply forming an exterior sidewall surface along said tube;

at least one protruding member positioned on said exterior surface; and a continuous label ply wrapped about the exterior surface of the body ply and said at least one protruding member so that said at least one protruding member forms at least one outwardly visible raised design on the portion of the label ply wrapped thereabout along the container sidewall.

15. A method of forming a raised design on a multi-ply tubular consumer products container, the container having a continuous liner ply wrapped about a longitudinal axis, a continuous body ply having a pair of spaced side edges wrapped about the liner ply and adhered thereto, and a continuous joint line extending the length of the body ply formed where the side edges of the body ply adjoin one another as the body ply is wrapped about the liner ply, said method comprising:

placing at least one protruding member on an exterior surface of the body ply at a position spaced from the joint line;

wrapping a label ply about the body ply and the at least one protruding member;

adhering the label ply to the body ply; and in response thereto, forming an outwardly visible raised design along an elongate sidewall of the container on that portion of the label ply wrapped about said at least one protruding member.

16. A method of forming a multi-ply tubular consumer products container, the container having an elongate continuous sidewall, said method comprising:

wrapping a continuous liner ply about an elongate container shaping mandrel;

wrapping a continuous body ply, the body ply having a pair of spaced side edges, about the liner ply and adhering the body ply to the liner ply;

forming a continuous joint line extending the length of the body ply where the side edges of the body ply adjoin one another as the body ply is wrapped about the liner ply;

placing at least one protruding member on an exterior surface of said body ply at a position spaced from said joint line;

wrapping a label ply about the body ply and the at least one protruding member and adhering the label ply to the body ply; and in response thereto, forming an outwardly visible raised design on the portion of the label ply wrapped about said at least one protruding member.

17. The method of claim 16, further comprising the step of permanently affixing said at least one protruding member to said body ply.

18. The method of claim 16, further comprising the steps of capturing said at least one protruding member between said body ply and said label ply and of retaining said at least one protruding member on said body ply by the tension of the overwrapped label ply.

19. The method of claim 16, wherein the step of placing said at least one protruding member on the body ply includes the step of wrapping said at least one protruding member about the body ply so that the protruding member extends at least partially along the sidewall of the container.

20. The method of claim 16, wherein the steps of wrapping the liner ply and the body ply about the shaping mandrel comprise the step of spirally winding the liner ply and the body ply about said mandrel at a common wind angle.

21. The method of claim 20, wherein the step of placing said at least one protruding member on said body ply further comprises the step of winding at least one continuous elongate strip member about the body ply at said wind angle.

22. The method of claim 20, wherein the step of placing said at least one protruding member on said body ply further comprises the step of winding at least two continuous elongate strip members about the body ply at said wind angle, said at least two strips being spaced from and parallel to one another.

23. The method of claim 20, wherein the step of placing said at least one protruding member on said body ply further comprises the step of winding a continuous elongate strip member having a series of spaced and raised graphic design members thereon about said body ply at said wind angle.

24. The method of claim 16, wherein the steps of wrapping the liner ply and the body ply about the shaping mandrel further comprise the step of guiding the liner ply and the body ply about said shaping mandrel to form a convolute container, and wherein the step of forming said joint line comprises the step of forming a continuous longitudinal seam extending the length of the body ply.

25. The method of claim 16, wherein the step of placing said at least one protruding member on said body ply further comprises the step of positioning at least one graphic design member on the exterior surface of said body ply.

26. The method of claim 25, further comprising the step of supplying said at least one graphic design member as a discrete graphic design member.

27. The method of claim 25, further comprising the steps of supplying said at least one graphic design member as a continuous strip member having a series of spaced and raised ones of said graphic design members provided thereon, and of wrapping said strip member about said body ply.

28. A method of forming an elongate multi-ply tubular consumer products container, the container having a continuous sidewall, said method comprising:

wrapping a continuous liner ply about a container shaping mandrel;

wrapping a continuous body ply about the liner ply and adhering the body ply to the liner ply;

forming a continuous joint line extending the length of the body ply where the body ply adjoins itself as the body ply is wrapped about the liner ply;

wrapping at least one protruding member about an exterior surface of said body ply at a position spaced from said joint line, and extending said at least one protruding member at least partially in a lengthwise direction of the container sidewall; and then wrapping a label ply about the body ply and the at least one protruding member, adhering the label ply to the body ply, and forming at least one outwardly visible raised design on the portion of the label ply wrapped about said at least one protruding member.

* * * * *